US005716130A

United States Patent [19]

Wood

[11] Patent Number: 5,716,130

[45] Date of Patent: Feb. 10, 1998

[54] VACUUM PUG MILL

[76] Inventor: Randolph C. Wood, 12501 Orr Springs Rd., Ukiah, Calif. 95482

[21] Appl. No.: 480,265

[22] Filed: Jun. 7, 1995

[51] Int. Cl.[6] ..... B01F 13/06; B28C 1/22

[52] U.S. Cl. ..... 366/75; 366/99; 366/139; 425/203

[58] Field of Search ..... 366/64, 66, 75, 366/77, 79, 81, 96–99, 139, 186, 194–196, 318; 425/203, 208, 209

[56] References Cited

U.S. PATENT DOCUMENTS

| | | | |
|---|---|---|---|
| 2,078,565 | 4/1937 | Durst et al. | 366/75 |
| 2,572,063 | 10/1951 | Skipper | 366/139 X |
| 2,868,144 | 1/1959 | Ambrette | 366/75 X |
| 3,493,031 | 2/1970 | Williams, Jr. et al. | 425/203 X |
| 3,946,996 | 3/1976 | Gergely | 366/139 |
| 4,322,169 | 3/1982 | Wood | 366/77 |
| 4,382,404 | 5/1983 | Hawley et al. | 366/139 X |
| 5,106,198 | 4/1992 | Muller | 425/203 X |
| 5,108,711 | 4/1992 | Chszaniecki | 425/203 X |

*Primary Examiner*—Charles E. Cooley
*Attorney, Agent, or Firm*—John D. McConaghy

[57] ABSTRACT

A pug mill having a housing including a drive and bearings for rotatably mounting and driving a cantilevered shaft extending from one side of the housing. Associated with the housing and concentrically arranged about the shaft are, in seriatim, a vacuum chamber, a mixing chamber, an extruder and a reduction cone. A port about the shaft is positioned between the vacuum chamber and the mixing chamber. A source of vacuum maintains a vacuum within the vacuum chamber and creates a vacuum within the mixing chamber by air passing through the port. An auger associated with the shaft positioned within the extruder forces clay toward the reduction cone. This creates a seal for maintaining vacuum within the mixing chamber and extrudes cylindrical blocks of conditioned clay without significant air bubbles.

18 Claims, 2 Drawing Sheets

VACUUM PUG MILL

BACKGROUND OF THE INVENTION

The field of the present invention is pug mills for mixing and conditioning clay for ceramics.

Pug mills are designed for producing clay conditioned for the manufacture of ceramics. The mills typically are used to mix clay powder and water or rehydrate, remix and/or recondition existing clay. Powders and water may also be mixed with existing clay to form a homogeneous product. The clay, once mixed, is most conveniently extruded through a reduction cone to form cylindrical or rectangular blocks also known as pugs.

A pug mill upon which the present design is based is disclosed in U.S. Pat. No. 4,322,169 entitled "CLAY MIXING APPARATUS", the disclosure of which is incorporated herein by reference. This pug mill includes a mixing chamber with an extruder in communication therewith. A shaft is rotatably mounted relative to the mixing chamber and the extruder. Mixing blades associated with the mixing chamber are fixed to the shaft as is an auger associated with the extruder. The shaft is rotatably mounted by bearings such that an extension of the shaft through the mixing chamber and the extruder is cantilevered from the bearings. The bearings are positioned in a housing including a drive motor and drive train for forcibly rotating the shaft. The shaft may be rotated in either direction about its axis. When rotated in a first direction, mixing takes place. When rotated in a second direction, the clay is advanced by the mixing blades and by the auger for extrusion through the reduction cone.

In addition to the conditioning of clay to achieve and appropriate moisture content and homogeneity, it is advantageous to remove as much air as possible. Air entrapped in the clay when fired can expand to ruin the article manufactured. Also entrapped air can adversely affect throwing operations as it makes the clay "short" and hard to work with. The pug mill disclosed in U.S. Pat. No. 4,322,169 does not provide, other than through the mixing process, for the removal of air from the material.

There are generally two types of machines which provide for the removal of air from the clay using a vacuum. These two types are characterized as "drop down" or "in line". A drop down vacuum pug mill uses two driven shafts each oriented horizontally with one above the other. Clay is mixed in a first chamber and then augured through a screen, also known as a shredder, at the end of the upper auger. The finely divided clay extruded through the screen enters a vacuum chamber. The vacuum chamber includes the lower shaft with an auger thereon extending from the lower portion of the vacuum chamber. The small pieces of clay drop through the vacuum chamber and expel air. The clay pieces are recombined in the lower auger with less entrapped air. The vacuum chamber is sealed at the inlet as the clay packs over the screen. A reduction cone at the end of the lower auger also becomes packed with clay to seal the outlet. Both shafts are sealed where they leave the vacuum chamber.

In line pug mills use a single shaft having a mixing chamber, a first auger, a screen or shredder, a vacuum chamber, an exit auger and a reduction cone in seriatim. Again, sealing takes place at the screen and at the reduction cone with the clay being subject to vacuum between these two elements. Retaining the vacuum holes free of clay is problematic on in line designs.

SUMMARY OF THE INVENTION

The present invention is directed to a pug mill which provides for vacuum associated with the mixing process.

In a first, separate aspect of the present invention, a sealable mixing chamber is employed where both mixing and vacuum air extraction occurs.

In a second, separate aspect of the present invention, a pug mill with a sealable mixing chamber includes a port through one wall of the mixing chamber associated with a source of vacuum. The port includes an element moving relative to the port and positioned in the port with clearance. In this way, the clearance is not permanently plugged by the clay during operation. A vacuum chamber may be presented behind the port so that clay materials passing through the clearance fall to the bottom of the chamber and do not plug the vacuum line.

In a third, separate aspect of the present invention, a pug mill includes a sealable mixing chamber having an extruder associated therewith. A shaft extends through the mixing chamber and the extruder. The mixing chamber includes blades fixed on the shaft while the extruder includes an auger fixed on the shaft. The shaft includes a portion extending through a port into the mixing chamber with clearance about the shaft. A vacuum source draws vacuum from the mixing chamber through the clearance about the shaft. A sleeve may be additionally provided on the portion of the shaft extending through the port.

In a fourth, separate aspect of the present invention, a pug mill having a sealable mixing chamber further includes a vacuum chamber with a port extending between the mixing chamber and the vacuum chamber. A shaft having blades associated with the mixing chamber and an auger associated with an extruder adjacent the mixing chamber is rotatably mounted by bearings which are displaced from the mixing chamber across the vacuum chamber to avoid contamination of the bearings by clay.

Accordingly, it is an object of the present invention to provide an improved pug mill. Other and further objects and advantages will appear hereinafter.

DETAILED DESCRIPTION OF THE PREFERRED EMBODIMENT

Figure 1:
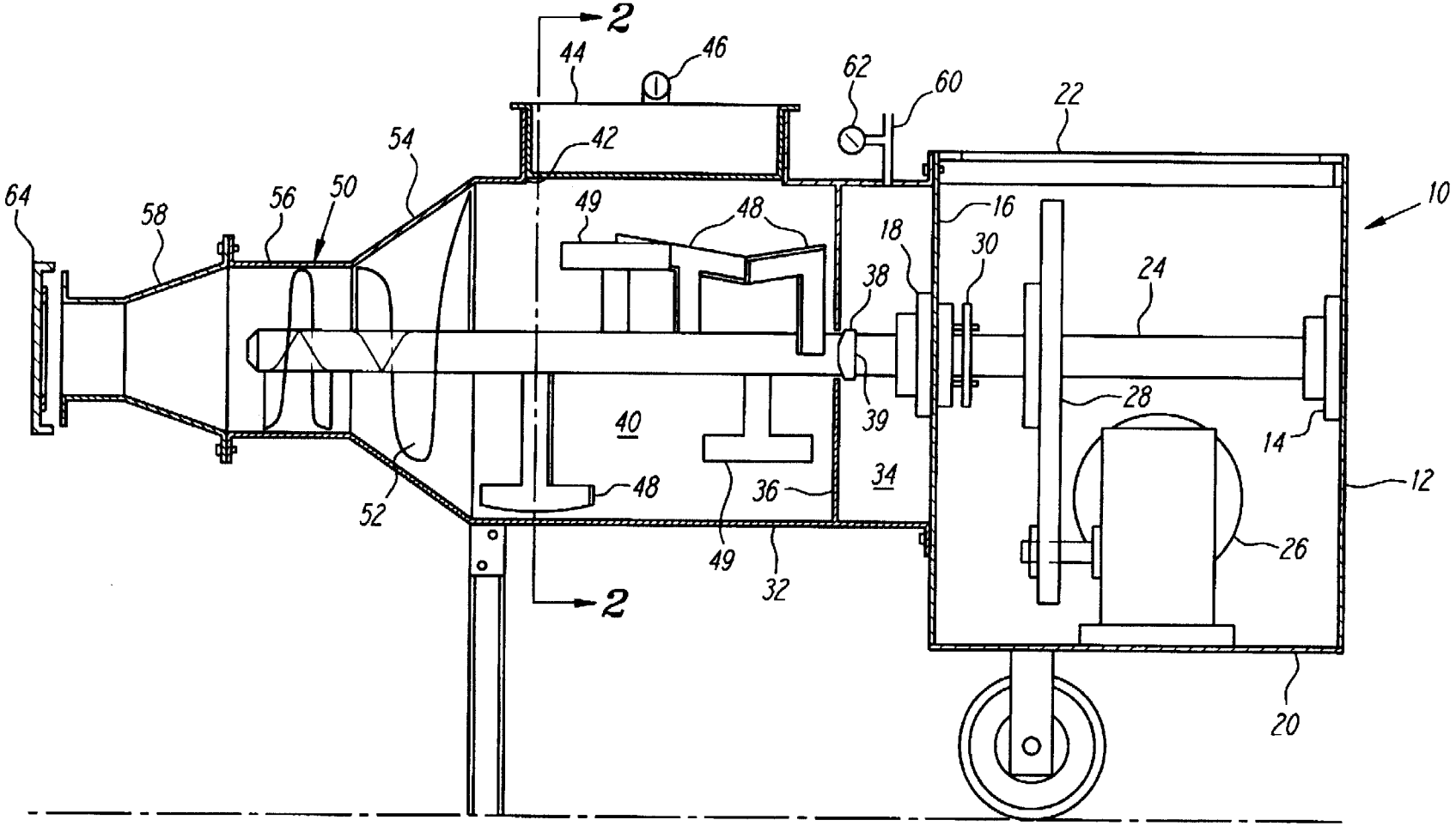
FIG. 1 is a cross-sectional side view of a pug mill.
Figure 2:
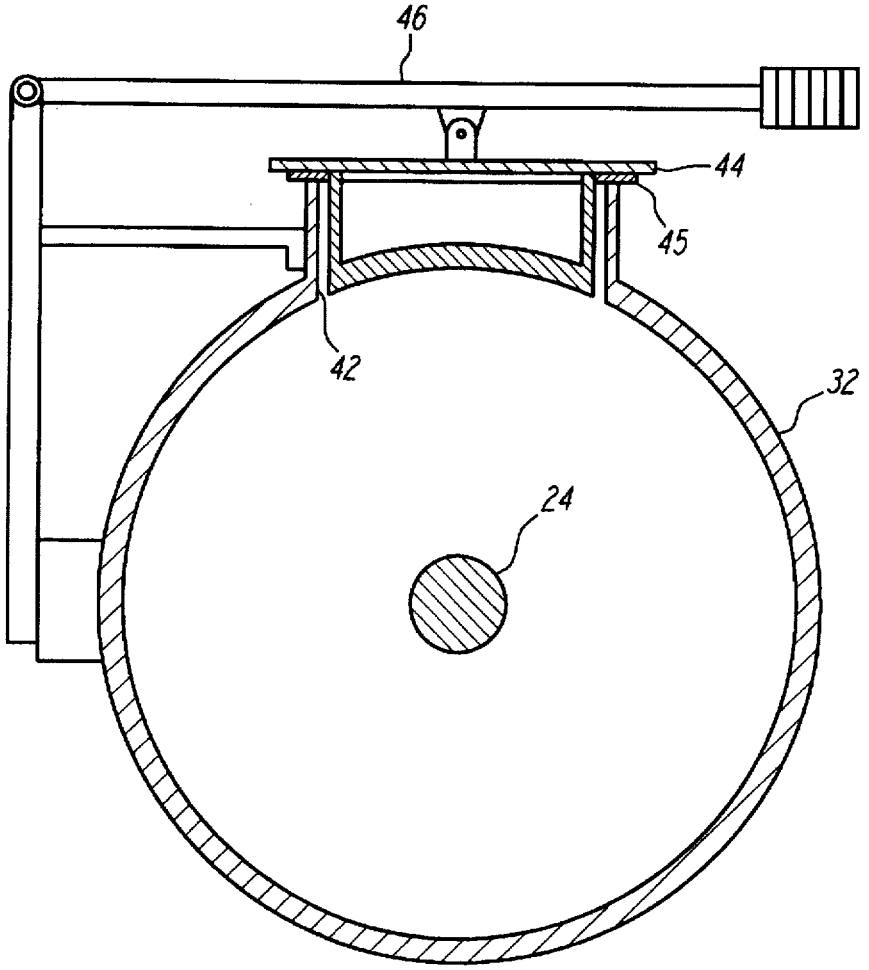
FIG. 2 is a cross-sectional end view taken along line 2—2 of FIG. 1.

Turning in detail to the drawing, a pug mill is illustrated which includes a housing 10 which is in the shape of a box. The back wall 12 of the housing supports a first bearing 14. A front wall 16 of the housing 10 supports a second bearing 18. Side walls and a floor 20 are also provided. A cover 22 may be used to enclose the mechanism found within the housing 10.

The first and second bearings 14 and 18 support a shaft 24 which is cantilevered from the front wall 16. The shaft 24 thus being rotatably mounted can be driven by a motor 26 positioned on the floor 20. A drive train 28 between the motor 26 and the shaft 24 includes a sprocket on each of the shaft of the motor 26 and the shaft 24 with a chain engaging both sprockets. A vacuum seal 30 is associated with the second bearing 18.

Figure 3:
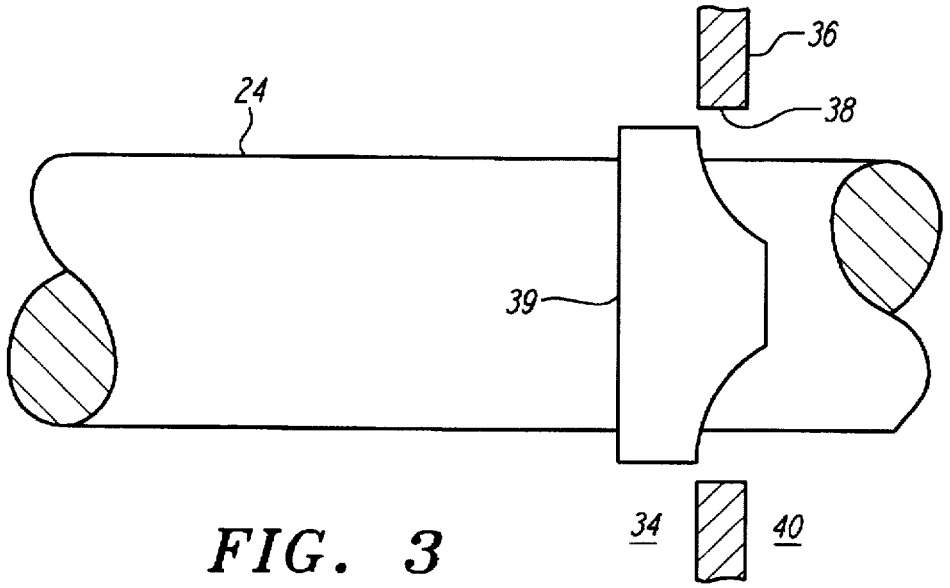
FIG. 3 is a cross-sectional detail of the port through the first wall with the shaft extending therethrough.

A cylindrical shell 32 extends concentrically about the shaft 24 outwardly of the housing 10. Immediately forward of the housing 10 is a vacuum chamber 34 defined by the shell 32, the front wall 16 and a first wall 36. The first wall 36 includes a port 38 through which the shaft 24 extends. This port 38 provides for unsealed clearance about the shaft 24 such that air may flow between the shaft 24 and the first wall 36. The shaft 24 includes a sleeve 39 which may be fixed by a set screw. The sleeve 39 has a scalloped end as shown. The side not seen on the other side of the shaft in FIG. 3 includes an identical end treatment. This end treatment helps to keep clay from passing through the port 38 regardless of the direction of shaft rotation.

Located on the other side of the first wall 36 from the vacuum chamber 34 is a sealable mixing chamber 40. This chamber 40 is also defined by the cylindrical shell 32 and the first wall 36. On top of the sealable mixing chamber 40 there is a material inlet 42. The material inlet 42 is large enough to accept pieces of clay for remixing. Positionable in the inlet is a hatch 44 which has a gasket 45 that is positioned between the hatch and the inlet 42 with the hatch in place. A lever 46 provides convenient actuation of the hatch 44. The hatch 44 extends down to define a portion of the cylindrical chamber. To assist in placement of the hatch 44, the lever 46 is pivotally associated with the hatch 44.

Mixing blades are associated with the mixing chamber 40 and are attached to the shaft 24. The mixing blades include three long blades 48 which closely approach the cylindrical shell 32. The long blade 48 most adjacent the front wall 16 is L-shaped while the other two long blades 48 are T-shaped. The laterally extending ends of the blades 48 overlap in the axial direction of the shaft 24 but are equiangularly spaced about the shaft 24 at 120° each. Two shorter blades 49 are also provided. The ends of the blades are inclined such that rotation of the shaft 24 in a first direction will cause the materials being mixed to stay within the mixing chamber 40. Rotation in the other direction causes the mixed clay to move toward the discharge. The orientation of the blades and of the auger are such that when the blades are moving clay toward the auger, the auger is advancing the clay through the extruder and out of the mill.

In communication with the mixing chamber 40 at one end of the cylindrical shell 32 is an extruder 50. The shaft 24 extends concentrically through the extruder and supports an auger 52 for extruding clay received from the mixing chamber 40. The extruder includes a conical transition portion 54 and a cylindrical conveying portion 56 to collect and extrude material through a reduction cone 58. The reduction cone 58 is designed to further reduce the diameter of the extruded clay, creating back pressure to insure proper compaction of the mixed clay. The reduced diameter of the reduction cone 58 is also instrumental in providing a seal in association with the clay for the mixing chamber 40.

The port 38 and the vacuum chamber 34 cooperate with a vacuum pump (not shown) to provide a source of vacuum through a connection 60. A vacuum gauge 62 is illustrated for monitoring the condition of the mixing chamber 40. Vacuums of 22 to 28 inches of Mercury appear sufficient.

In operation, materials to be mixed are added to the sealable mixing chamber 40 through the material inlet 42. Mixing may take place for a period of time without vacuum such that the material can be monitored through the material inlet 42 to assure appropriate final consistency. With the hatch 44 in place, vacuum is then drawn through the source of vacuum. Vacuum is drawn on the vacuum chamber 34. This also evacuates the mixing chamber 40 through the port 38. Because the shaft 24 is rotating, material does not pack over the clearance about the shaft 24 in the port 38. The scalloped end treatment of the sleeve 39 also acts to keep clay clear of the port 38 regardless of the rotational direction of the shaft 24.

The shaft 24 provides a dynamic element within the port 38 to keep the clearance therebetween clear of material. In this way, air flow is assured through the port 38. Consequently, substantially the same vacuum is drawn on both the vacuum chamber 34 and the mixing chamber 40.

Because of the displacement of the second bearing 18 from the mixing chamber 40 across the vacuum chamber 34, clay may pass through the port 38 but falls from the shaft before contamination of the bearing 18. A flange barrier may be positioned on the shaft if movement of material along the shaft becomes a problem.

To appropriately seal the extruder 50 which is always in communication with the mixing chamber 40, either a cover 64 may be placed on the end of the reduction cone 58 or mixed clay must fill the reduction cone 58. To initiate operation, a cover may be positioned on the end of the reduction cone 58. Mixing with the shaft 24 rotating in a first direction then takes place first without vacuum while material is being loaded and the appropriate proportion of water and clay is achieved and second under vacuum. The shaft may then be rotated in the opposite direction. The blades 48 are oriented such that they force the mixed clay toward the auger 52. The clay passes through the auger 52 and through the reduction cone 58. As the clay passes through the reduction cone 58, it creates a seal. The cover may then be removed from the end of the reduction cone 58 or simply pushed off by the clay being extruded. If batches of clay are prepared on a frequent basis, the clay remaining in the reduction cone 58 may be left as a seal for each succeeding batch. Alternatively, a cover may be again positioned over the end of the reduction cone 58 to insure proper sealing.

Thus, an improved pug mill capable of removing air is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A pug mill comprising a sealable mixing chamber including a first wall;

an extruder in communication with the mixing chamber;

a source of vacuum in communication with the mixing chamber including a port extending through the first wall and an element in the port movable relative to the first wall, there being clearance for air to pass through between the element and the port, the element being rotatable and having a scalloped surface facing the sealable mixing chamber at the first wall;

a shaft rotatably mounted relative to and extending through the mixing chamber, the mixing chamber including mixing blades mounted to the shaft.

2. The pug mill of claim 1, the shaft extending through the extruder, the extruder including an auger mounted to the shaft.

3. The pug mill of claim 2 further comprising a reduction cone at the discharge end of the extruder.

4. The pug mill of claim 1, the source of vacuum further including a vacuum chamber on the other side of the first wall from the mixing chamber and in communication with the port, the first wall being vertical at the port, the vacuum chamber extending at least downwardly from the port in operation.

5. The pug mill of claim 1, the element further including a sleeve, the sleeve having the scalloped surface facing the sealable mixing chamber.

6. The pug mill of claim 1, the source of vacuum further including a vacuum chamber on the other side of the first wall from the mixing chamber and in communication with the port.

7. The pug mill of claim 6 further comprising a bearing on the shaft, the bearing being spaced from the mixing chamber on the other side of the vacuum chamber.

8. The pug mill of claim 1, the element in the port being an extension of the shaft from the mixing chamber.

9. A pug mill comprising a sealable mixing chamber including a material inlet with a sealing hatch closing the inlet;

an extruder including an auger in communication with the mixing chamber;

a source of vacuum in communication with the mixing chamber including a port open to the mixing chamber, an element in the port movable relative to the mixing chamber, there being an unsealed clearance for air to pass through between the element and the port, the element being rotatable and having a scalloped surface facing the sealable mixing chamber at the port;

a shaft rotatably mounted relative to and extending through the mixing chamber and the extruder, mounting the auger, the mixing chamber including mixing blades mounted to the shaft.

10. A pug mill comprising a sealable mixing chamber including a first wall and a material inlet with a sealing hatch closing the inlet;

an extruder in communication with the mixing chamber;

a source of vacuum in communication with the mixing chamber including a port extending through the first wall, an element in the port movable relative to the first wall, there being an unsealed clearance for air to pass through between the element and the port, and a vacuum chamber on the other side of the first wall from the mixing chamber and in communication with the port, the element including a rotary shaft having a sleeve on the shaft with a scalloped end facing through the port toward the sealable mixing chamber.

11. The pug mill of claim 10 further comprising a reduction cone at the discharge end of the extruder.

12. The pug mill of claim 10, the first wall being vertical at the port, the vacuum chamber extending at least downwardly from the port in operation.

13. A pug mill comprising a sealable mixing chamber including a first wall;

an extruder in communication with the mixing chamber;

a shaft rotatable mounted relative to and extending through the mixing chamber and the extruder, the mixing chamber including mixing blades mounted to the shaft and the extruder including an auger mounted to the shaft;

a source of vacuum in communication with the mixing chamber including a port extending through the first wall, the shaft extending through the port with unsealed clearance for air passage though between the shaft and the port;

a sleeve on the shaft with a scalloped end facing through the port toward the sealable mixing chamber.

14. The pug mill of claim 15 further comprising a vacuum chamber on the other side of the first wall from the mixing chamber and in communication with the port.

15. The pug mill of claim 14 further comprising a bearing on the shaft, the bearing being spaced from the mixing chamber on the other side of the vacuum chamber.

16. The pug mill of claim 13 further comprising a reduction cone at the discharge end of the extruder.

17. The pug mill of claim 13, the mixing chamber further including a material inlet with a hatch closing the inlet.

18. A pug mill comprising a sealable mixing chamber including a first wall and a material inlet with a sealing hatch closing the inlet;

an extruder in communication with the mixing chamber;

a source of vacuum in communication with the mixing chamber including a port extending through the first wall, an element in the port movable relative to the first wall, there being an unsealed clearance for air to pass through between the element and the port, and a Vacuum chamber on the other side of the first wall from the mixing chamber and in communication with the port, the element having a scalloped, radially extending surface facing the sealable mixing chamber at the first wall.

* * * * *